US005167563A

United States Patent [19]

Saffer

[11] Patent Number: 5,167,563

[45] Date of Patent: Dec. 1, 1992

[54] TOY VEHICLE HAVING CHANGEABLE APPEARANCE

[75] Inventor: Gary M. Saffer, Rancho Palos Verdes, Calif.

[73] Assignee: Mattel, Inc., El Segundo, Calif.

[21] Appl. No.: 832,566

[22] Filed: Feb. 7, 1992

[51] Int. Cl.[5] ..... A63H 17/26

[52] U.S. Cl. ..... 446/465; 446/466

[58] Field of Search ..... 446/469, 465, 470, 466, 446/431

[56] References Cited

U.S. PATENT DOCUMENTS 5,022,884 6/1991 Hippely et al. ..... 446/470 X

*Primary Examiner*—Mickey Yu

*Attorney, Agent, or Firm*—Roy A. Ekstrand

[57] ABSTRACT

A toy vehicle having a changeable appearance figure includes a body having a support chassis secured thereto. A pivotal beam is pivotally secured to the chassis and pivotally movable with respect to the chassis and body. The rear portion of the pivotal beam supports a pair of rotatable rear wheels while the front portion of the pivotal beam supports a simultated vehicle engine. The body defines a hood aperture through which the simulated engine partially extends. The beam may be pivoted between a first position in which the simulated engine extends partially through the hood aperture and the rear wheels are generally received within the vehicle body and an alternate position in which the rear wheels are pivoted downwardly to extend from the vehicle body and in which the engine extends upwardly an increased distance through the hood aperture. A detent mechanism is coupled between the pivotal beam and the chassis to detent the pivotal beam in either the alternate positions. A pair of enlarged rear wheels are configured to be received upon the rear wheels of the vehicle to provide an enlarged rear tire on each side of the vehicle.

7 Claims, 2 Drawing Sheets

TOY VEHICLE HAVING CHANGEABLE APPEARANCE

FIELD OF THE INVENTION

This invention relates generally to toy vehicles and particularly to those which provide a changeable appearance.

BACKGROUND OF THE INVENTION

Toy vehicles which generally comprise miniaturized versions of full-size vehicles, either real or fanciful, have proven to be an extremely popular type of toy among children for many years. This popularity has been enhanced by a virtually endless variety of toy vehicle shapes, sizes and configurations. Perhaps one of the most exciting developments in such toy vehicles took place with the creation of toy vehicles having the ability to be changed or altered in their appearance.

For example, U.S. Pat. No. 3,748,780 issued to Glass, et al. sets forth a TOY VEHICLE having a body and frame which supports rolling and driving wheels. The frame is formed in two portions which are movable relative to each other. A motor means is supported upon one frame portion for moving the frame portions relative to each other while driving the driven wheels of the toy. The body includes portions interrelated to the frame so as to move with respect to the frame as the frame components undergo relative motion. In the example shown, the vehicle transforms from a relatively sedate looking conventional coupe-type vehicle to a racing-type "funny car" having an upwardly extending raised motor and rear driver's cockpit emerging from the body as the vehicle is operated.

U.S. Pat. No. 4,655,727 issued to Swisher, et al. sets forth a TOY VEHICLE having a base portion, a top portion and a mechanical arrangement linking the base portion to the top portion whereby the top portion is movable to a number of different positions with respect to the base portion. A pair of pivoting axles and axle receptacles cooperate to pivotally move the base portion and top portion relative to each other to cause the vehicle to assume different appearances.

U.S. Pat. No. 4,666,420 issued to Nagno sets forth a TOY CAR OF A FRONT WHEEL DRIVING TYPE having front wheels for driving and changing direction supported upon a chassis. A lifting rod connected to the chassis supports a rear axle and is pivotally secured to the chassis so as to allow the lifting rod to move away from and toward the chassis. A setting device connected to the lifting rod for setting its pivotable position is coupled to a front bumper extending forwardly a sufficient distance to prevent forward tumble of the car.

U.S. Pat. No. 4,696,655 issued to D'Andrade, et al. sets forth a TOY VEHICLE WITH ADJUSTABLE SUSPENSION SYSTEM having a body and supporting wheels coupled to support means and a suspension system. The wheel support means connect the body and wheels in conjunction with the suspension system such that the body may be raised or lowered merely by pulling or pushing the wheels with respect to the underside of the body. The suspension system includes a plurality of hollow plastic tubes each having a plurality of circumferential corrugations which permit the plastic tubes to be varied in length and thereby adjust vehicle heighth.

U.S. Pat. No. 4,822,316 issued to Shaffer, et al. sets forth a TOY VEHICLE having a toy body and a plurality of support wheels. A multiply articulated suspension system includes pivotally coupled suspension linkages between the supporting wheels and the vehicle body. The relative angular positions between the linkage arms of the suspension system permit the vehicle heighth and wheel base to be adjusted to multiple configurations.

U.S. Pat. No. 4,850,929 issued to Genevey sets forth a TOY VEHICLE WITH PIVOTING AXLE in which an axle is configured in the form of a stirrup having a pair of spaced bearings for supporting an axle shaft coupled to supporting wheels. The stirrup is selectively receivable within a notch or slot depending from the vehicle chassis in a raised position or, alternatively, within a second slot or notch vertically displaced relative to the chassis. Thus, the distance between supporting axles and the vehicle body may be altered by rotational movement of the stirrups.

U.S. Pat. No. 4,889,516 issued to Auer, et al. sets forth a PLUG-IN MODULE FOR MOTORIZED TOY VEHICLE in which a power module is removably receivable within an open compartment of the body of a motorless toy vehicle. The module includes a DC motor and battery supply together with operative coupling means which engage the toy vehicle drive system and provide driving power for the toy vehicle.

French Patent 2,616,352 sets forth a vehicle supported by a plurality of cogged wheels rotatably supported upon wheel axles. A corresponding plurality of outer wheels include splind apertures configured to be receivable upon and engaged to the cogged wheels of the vehicle.

German Patent DE3526304A1 sets forth a vehicle having a body supported by a pair of support axles. A plurality of wheels having different diameters are receivable upon the axles to support the vehicle.

U.S. Pat. No. 4,773,889 issued to Rosenwinkel, et al. sets forth a WHEEL FOR A TOY VEHICLE having the capability of changing wheel diameter. The wheel includes a hollow shell of rubber or other flexible material and opposed side walls which are movable relative to each other. The distance between the movable side walls causes the flexible wheel to be compressed or expanded in axially width thereby providing a change of wheel diameter.

U.S. Pat. No. 4,540,377 issued to Rehkemper, et al. sets forth a TOY VEHICLE CONVERSION ACCESSORY having a pair of spaced apart axles secured to an elongated transverse central frame member. Relatively large lugged wheels are attached to opposite ends of each axle. Mounting wells for releasibly receiving the wheels of the vehicle are carried by the axles adjacent each lugged wheel to support the vehicle upon the conversion assembly. As a result, a conventional toy vehicle may be received within the wells and supported therein to give the appearance of a raised enlarged wheel vehicle.

U.S. Pat. No. 4,865,337 issued to Disler, et al. sets forth a CONVERTIBLE MULTI-PURPOSE TOY having a plurality of interchangeably couplable body parts which permit the toy to be configured in different operative configurations such as a tricycle or other device.

While the foregoing described prior art devices have provided increased amusement and enjoyment, in many instances, there remains a continuing need in the art for evermore varied and interesting changeable toy vehicles. In addition, a continuing need also exists for changeable toy vehicles which respond to the economic pressures upon manufacturers for manufacturing such toy vehicles at reduced cost and expenses.

SUMMARY OF THE INVENTION

Accordingly, it is a general object of the present invention to provide an improved changeable configuration toy vehicle. It is a more particular object of the present invention to provide an improved toy vehicle having changeable appearance which may be easily manufactured at manufacturing and component costs which are generally similar to vehicles not having the changeable appearance feature.

In accordance with the present invention, there is provided a toy vehicle comprises: a vehicle body defining an interior cavity, a hood portion and hood aperture; a chassis secured to the vehicle body and supporting a first pair of wheels; a pivot beam pivotally secured to the chassis and having a first end and a second end; a simulated engine supported upon the first end within the hood aperture; a second pair of wheels supported by the second end of the pivot beam; and latch means coupled to the chassis and the pivot beam for detenting the angular position of the pivot beam with respect to the chassis in either a first position in which the simulated engine is lowered and the second pair of wheels is raised with respect to the chassis or a second position in which the simulated engine is raised and the second pair of wheels is lowered relative to the first position.

BRIEF DESCRIPTION OF THE DRAWING

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
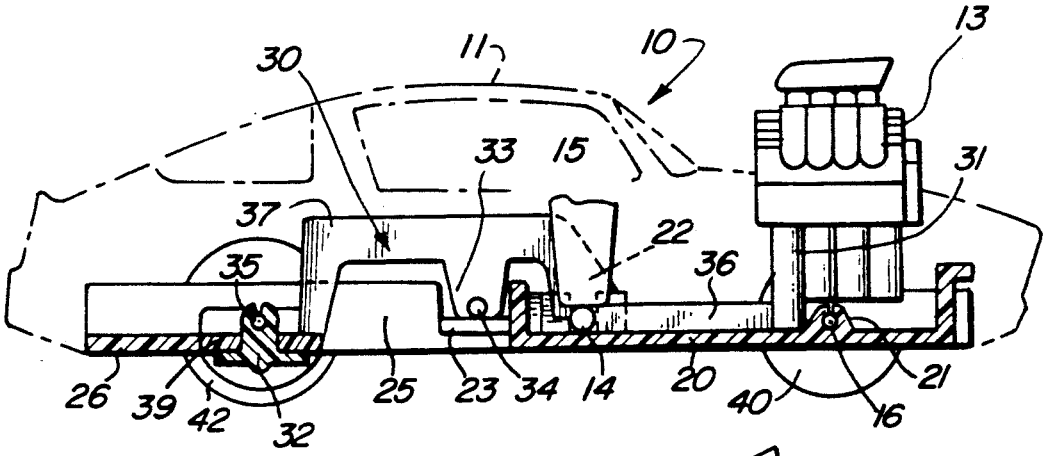
FIG. 1 sets forth a partial section view of a toy vehicle constructed in accordance with the present invention in a first vehicle appearance configuration.

FIG. 1 sets forth a section view of a toy vehicle having changeable appearance constructed in accordance with the present invention and generally reference by numeral 10. Toy vehicle 10 includes a body 11 (better seen in FIG. 4) which, for purposes of illustration, is shown in dashed line representation in FIG. 1. Toy vehicle 10 further includes a support chassis 20 having a generally planar configuration and defining a support surface 24 together with a front axle receiver 21. A conventional front axle 16 is received within axle receiver 21 and supports a pair of front wheels 40 and 41 (the latter seen in FIG. 3). Chassis 20 further includes an upwardly facing pivot notch 22 and should be understood to be securely attached to body 11 by conventional fabrication means not shown. In accordance with the present invention, chassis 20 further defines an elongated opening 25 and a rear transverse support member 26. Chassis 20 further includes a pair of latch members 23 and 27 (the latter seen in FIGS. 5*a* through 5*c*).

A pivotable beam 30 includes a generally cylindrical pivot 14 near its center and a pair of outwardly extending arms 36 and 37. Beam 30 is pivotally secured to chassis 20 by the insertion of cylindrical pivot 14 within notch 22 of chassis 20. Beam 30 is further captivated in the pivotal attachment to chassis 20 by a downwardly extending pivot lock 15 which covers the upper portion of notch 22 and bears downwardly upon pivot 14. In its preferred form, pivot lock 15 is formed integrally with and supported by body 11 such that assembly of body 11 to chassis 20 in accordance with conventional fabrication techniques will captivate pivot 14 and beam 30 within notch 22. When assembled in the manner shown in FIG. 1, arm 36 of beam 30 extends forwardly from pivot 14 and terminates in an upwardly extending engine support 31. A simulated engine 13 is supported upon engine support 31 and extends upwardly through an aperture 12 formed in body 11 which is better seen in FIG. 4.

Arm 37 of beam 30 extends upwardly and rearwardly from pivot 14 and defines a downwardly extending latch arm 33 which in turn defines an extending latch button 34. As is better seen in FIGS. 5*a* through 5*c*, beam 30 further includes a second latch arm 37 having a extending latch button 38. Arm 37 extends downwardly through opening 25 of chassis 20 and forms an axle support 39 which in turns receives an axle carrier 32 in accordance with conventional fabrication techniques. Axle carrier 32 supports a conventional rear axle 35 which in turn supports a pair of rear wheels 42 and 43 (the latter seen in FIG. 3).

In accordance with the detenting mechanism set forth below in FIGS. 5*a* through 5*c* in greater detail, the cooperation of latch arm 33, latch button 34 and latch member 23 maintains the generally horizontal position of beam 30 with respect to body 11 shown in FIG. 1. When so positioned, arm 36 of beam 30 rests upon surface 24 of chassis 20 and pivotal motion of beam 30 is restrained. As a result, simulated engine 13 extends partially through hood aperture 12 (seen in FIG. 4) while rear axle carrier 32 is maintained within the interior of body 11.

As a result, the configuration of toy vehicle 10 shown in FIG. 1 is maintained in a stable manner permitting the child user to utilize toy vehicle 10 in accordance with the normal play patterns of such toy vehicles. In accordance with an important aspect of the present invention, toy vehicle 10 may be easily converted to an alternate configuration having a different appearance by the user's application of a drawing force upon rear wheels 42 and 43 in the manner shown in FIG. 3. With temporary reference to FIG. 3, it may be seen that the downward drawing force upon rear wheels 42 and 43 in the direction of arrow 50 causes a corresponding upward motion of engine 13 through hood aperture 12 in the direction indicated by arrow 51 due to the intermediate positioning of pivot 14 which supports beam 30.

Figure 2:
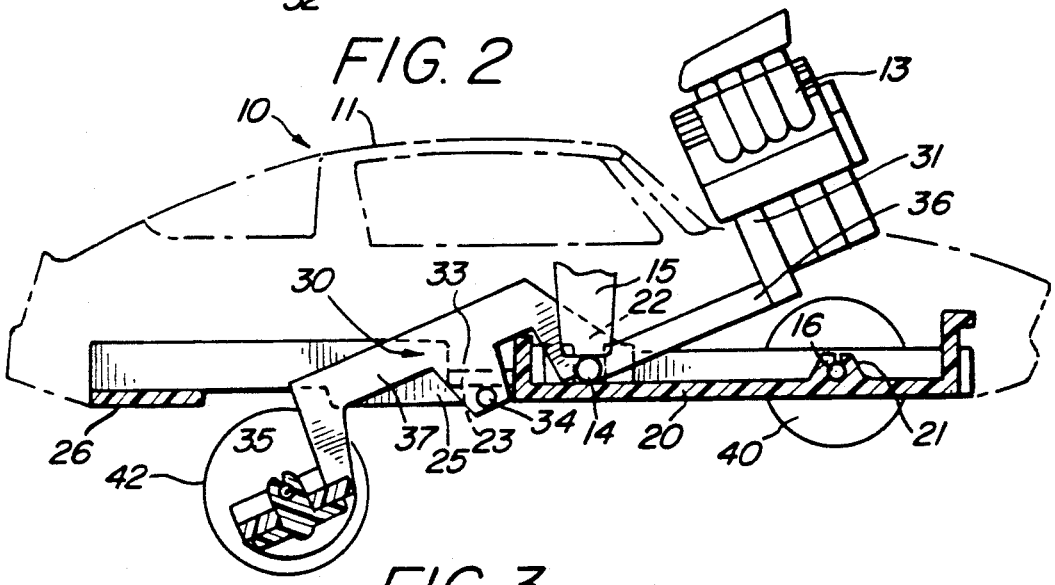
FIG. 2 sets forth a partial section view of the present invention toy vehicle configured for an alternate appearance configuration.

FIG. 2 sets forth a partial section view of toy vehicle 10 showing the configuration of toy vehicle 10 in its alternate configuration resulting from the above-described manipulation of rear wheels 42 and 43. As is set forth above, body 11 supports a chassis 20 defining a surface 24, a pivot notch 22, an opening 25 and a transverse support member 26. As is also set forth above, chassis 20 defines a latch member 23. With temporary reference to FIGS. 5*a* through 5*c*, it should be noted that chassis 20 also further defines a similar latch member 28 on the opposite side of opening 25. As is set forth above, a pivotally secured beam 30 includes a pivot 14 captivated within notch 22 and having a forwardly extending arm 36 and rearwardly extending arm 37. Arm 36 terminates in an upwardly extending engine support 31 which in turn supports simulated engine 13 while arm 37 includes a pair of downwardly extending latch arms 33 and 37 (the latter seen in FIGS. 5*a* through 5*c*). Arm 37 further includes an axle support 39 which receives rear axle carrier 32. The latter supports a rear axle 35 which in turn supports rear wheels 42 and 43.

Figure 5A:
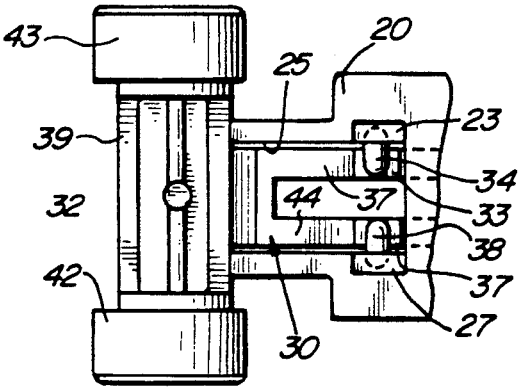
FIGS. 5*a*, 5*b* and 5*c* set forth partial section views showing the detenting mechanism of the present invention toy vehicle in operation.
Figure 5B:
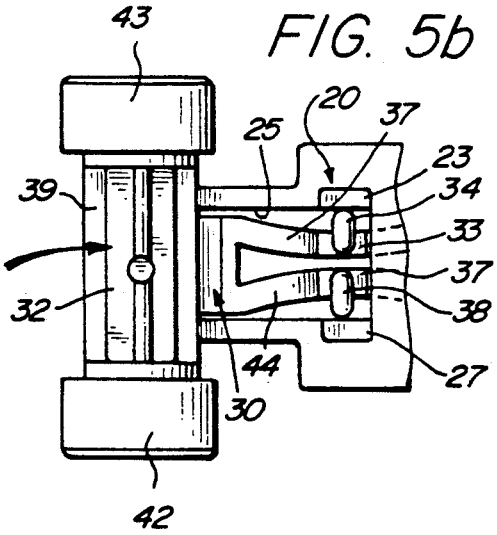
Figure 5C:
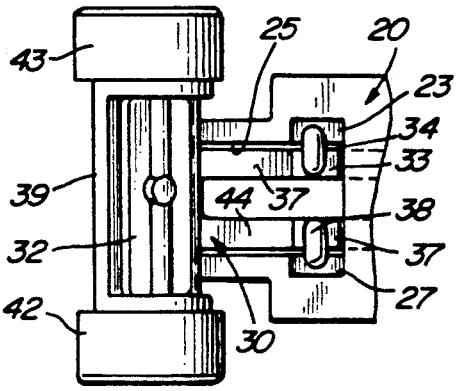

Comparison of FIGS. 1 and 2 shows that the pivotal motion of beam 30 with respect to body 11 raises simulated engine 13 upwardly through aperture 12 while simultaneously lowering rear axle carrier 32 and thereby rear wheels 42 and 43 to a substantially extended position beneath the rear portion of body As is set forth in greater detail in FIGS. 5*a* through 5*c*, the downward force upon rear wheels 42 and 43 required to pivot beam 30 must be sufficient to overcome the latching action between latch buttons 34 and 38 against latch members 23 and 28 and thus permit beam 30 to pivot from the position shown in FIG. 1 to that shown in FIG. 2. Once beam 30 pivots to the position shown in FIG. 2, the operation of the latching mechanism set forth in greater detail in FIG. 5*a* through 5*c* cooperates to preclude pivotal motion of beam 30 in the direction raising rear wheels 42 and 43 permitting toy vehicle 10 to be supported upon a play surface in a "nose-down" attitude which produces a different appearance characteristic for toy vehicle 10. Thus, beam 30 may be alternatively pivoted between the positions shown in FIG. 1 and 2 to provide alternative configurations in which engine 13 is either raised or lowered with respect to body 11 and in which rear wheels 42 and 43 are alternatively lowered from or received partially within body 11 to alter the appearance configuration of the present invention toy vehicle.

Figure 3:
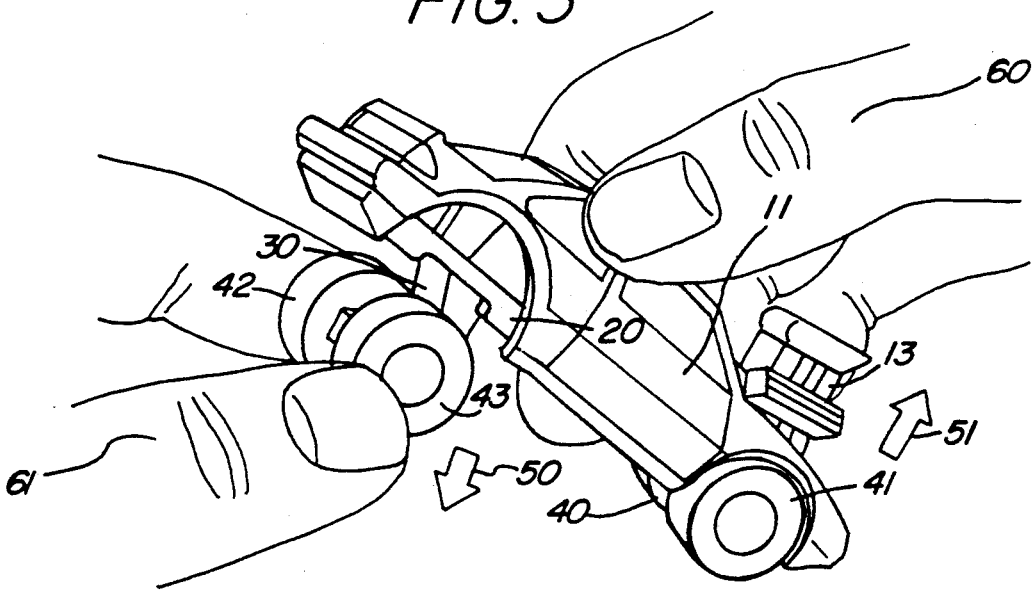
FIG. 3 sets forth a perspective view of the present invention toy vehicle being changed between alternate configurations.
Figure 4:
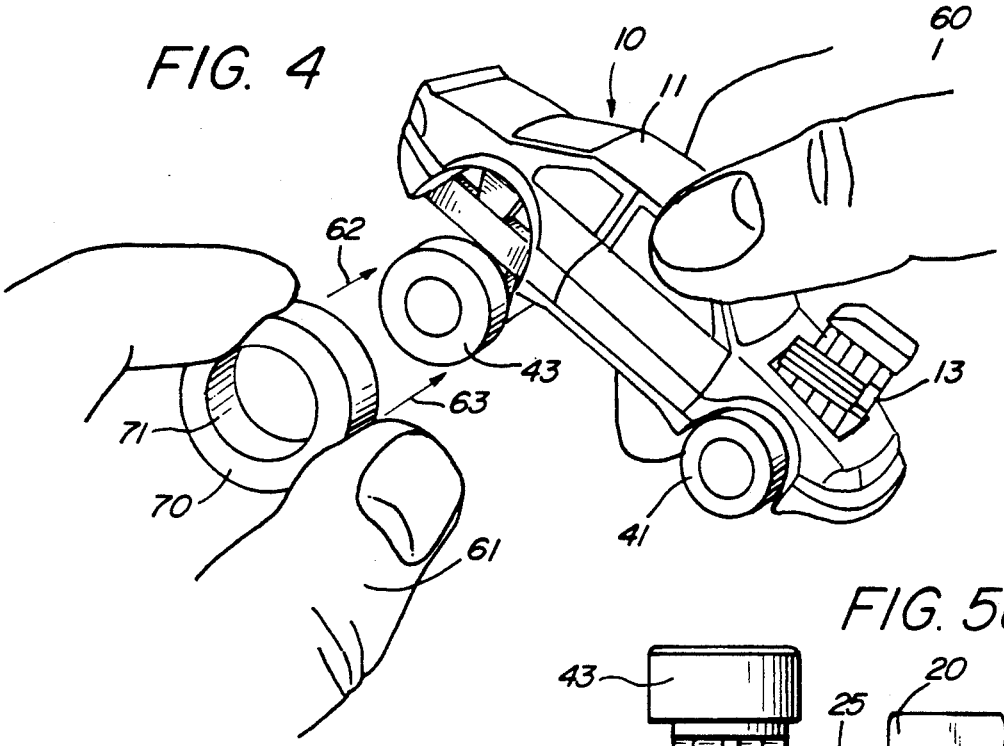
FIG. 4 sets forth a perspective view of the present invention toy vehicle being further changed in appearance.

FIGS. 3 and 4 set forth perspective views of a further change in the appearance configuration of the present invention toy vehicle once beam 30 has pivoted and latched into the extended position of FIG. 2. Specifically, with reference to FIG. 3 which sets forth a perspective view of toy vehicle 10 held by a pair of user hands 60 and 61, hand 60 holds body 11 of toy vehicle 10 which, as mentioned, supports front wheels 40 and 41 in the manner described above. In addition, hand 61 is shown grasping rear wheels 42 and 43 which, as described above, are supported by beam 30 shown extending downwardly from the rear portion of chassis 20. As can be seen, hand 61 exerts a downward force upon rear wheels 42 and 43 in the direction indicated by arrow 50 which overcomes the securing force of the latch mechanism provided by latch arms 33 and 37 together with latch buttons 34 and 38 (seen in FIG. 5). As wheels 42 and 43 are drawn downwardly in the direction indicated by arrow 50, beam 30 pivots in the manner shown in FIGS. 1 and 2 causing engine 13 to be raised upwardly through hood aperture 12 (seen in FIG. 4) in the direction indicated by arrow 51. In the position shown in FIG. 3, the pivotal motion of beam 30 is complete and beam 30 has become locked in the position shown in FIG. 2.

FIG. 4 sets forth the final operation in reconfiguring toy vehicle 10 from the more sedate configuration shown in FIG. 1 to a more race-like configuration. Thus, in FIG. 4, hand 60 is shown holding toy vehicle 10 by grasping body 11. As described above, engine 13 extends upwardly through hood aperture 12 while rear wheels 42 and 43 extend downwardly in the configuration shown in FIG. 2. An enlarged wheel 70 defines a generally annular member having a center passage 71, the diameter of which is selected to correspond to the outer diameter of rear wheel 43. Thus, the attachment of enlarged wheel 70 to rear wheel 43 is accomplished by the user in grasping enlarged wheel 70 and, after properly aligning it with wheel 43, moving enlarged wheel 70 in the direction indicated by arrows 62 and 63 to insert rear wheel 43 within center passage 11 of enlarged wheel 70 in a snap-fit attachment. The resulting attachment of enlarged wheel 70 to wheel 43 produces a still further alternation in the appearance of toy vehicle 10. The final step in reconfiguration of toy vehicle 10 is carried forward by performing a similar operation using a second enlarged wheel (not shown) which is fitted upon rear wheel 42 to give toy vehicle 10 a pair of enlarged rear wheels causing a further nose-down stance and an even more race-like appearance for toy vehicle 10. It will be apparent to those skilled in the art that the appearance of toy vehicle 10 may be returned to the more sedate configuration shown in FIG. 1 by simply removing the enlarged wheels from rear wheels 42 and 43 and pivoting beam 30 with respect to body 11 to return to the position shown in FIG. 1.

FIGS. 5*a* through 5*c* set forth the sequential operation of the position detent or latching mechanism which operates to maintain beam 30 in either of the positions shown in FIGS. 1 and 2. Thus, with reference to FIG. 5*a*, the rear portion of chassis 20 is shown. As described above, chassis 20 includes an opening 2i and a pair of inwardly extending latch members 23 and 27. A pivotally supported beam 30, the structure of which is set forth above, includes a pair of rearwardly extending arms 37 and 44 which terminate in a transversely extending axle support 39. Axle support 39 receives and supports an axle carrier 32 which in turn rotatably supports a pair of rear wheels 42 and 43. As described above, beam 30, in its pivotal motion, permits arms 37 and 44 to pivot with respect to chassis 20 and pass through opening 25 thereof. Arm 37 includes a downwardly extending latch arm 33 which in turn includes an outwardly extending latch button 34. Similarly, arm 44 includes a downwardly extending latch arm 37 which includes an outwardly extending latch button 38. In the position shown in FIG. 5*a*, beam 30 is pivoted with respect to chassis 20 to the position shown in FIG. 1. Thus, latch buttons 34 and 38 extend outwardly above latch members 23 and 27 to preclude pivotal motion of beam 30 with respect to chassis 20.

FIG. 5*b* sets forth the positions assumed by the latching mechanism shown in FIG. 5*a* at an intermediate pivotal position of beam 30. Thus, with temporary reference to FIGS. 1 and 2, it will be apparent that FIG. 5*b* sets forth the resulting positions of arms 37 and 44 together with latch arms 33 and 37 and latch buttons 34 and 38 which occur once the drawing force upon rear wheels 42 and 43 become sufficient to cause arms 37 and 44 to flex or bend to the position shown in FIG. 5*b*. Thus, once sufficient drawing force has been applied, latch buttons 34 and 38 are forced inwardly causing arms 37 and 44 respectively to bend or flex to the position of 5*b* which in turn permits latch buttons 34 and 38 to be moved past latch members 23 and 27 respectively. It should be apparent that the position shown in FIG. 5*b* is an intermediate position which does not correspond to either latched or detented position shown in FIGS. 1 and 2.

FIG. 5*c* sets forth the latching mechanism of the present invention toy vehicle further displaced from the position shown in FIG. 5*b* by continued pivotal motion of beam 30 in the manner shown in FIG. 3 and corresponding to the position shown in FIG. 2. Thus, as can be seen in FIG. 5*c*, once latch buttons 34 and 38 are drawn past latch members 23 and 28 respectively, the resilient spring action of arms 37 and 44 forces latch buttons 33 and 38 outwardly to positions extending beneath latch members 23 and 28 respectively. At this point, the latch mechanism has assumed the locked position shown in FIG. 2 characterized by the upward extension of engine 13 and the downward extension of rear wheels 42 and 43.

It will be apparent to those skilled in the art that the position of beam 30 may be returned to the position of FIG. 1 by reversing the above-described process and forcing rear wheels 42 and 43 upwardly toward chassis 20 which in turn forces latch buttons 34 and 38 inwardly once again to the position of 5*b* afterwhich the continued upward rotation of rear wheels 42 and 43 returns the latch mechanism to the position shown in FIG. 5*a*.

It will be apparent to those skilled in the art that the toy vehicle shown in FIGS. 1 through 5 set forth a changeable appearance structure for a toy vehicle which achieves substantial appearance change without excessive material and fabrication costs beyond those normally incurred in the manufacture of more conventional toy vehicles which lack the changeable appearance characteristic of the present invention. Thus, the present invention structure shown and described above provides many of the advantages of changeable appearance toy vehicles without the complexity and increased manufacturing costs which prior art systems have necessitated.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle comprising:

a vehicle body defining an interior cavity, a hood portion and hood aperture;

a chassis secured to said vehicle body and supporting a first pair of wheels;

a pivot beam pivotally secured to said chassis and having a first end and a second end;

a simulated engine supported upon said first end within said hood aperture;

a second pair of wheels supported by said second end of said pivot beam; and latch means coupled to said chassis and said pivot beam for detenting the angular position of said pivot beam with respect to said chassis in either a first position in which said simulated engine is lowered and said second pair of wheels is raised with respect to said chassis or a second position in which said simulated engine is raised and said second pair of wheels is lowered relative to said first position.

2. A toy vehicle as set forth in claim 1 wherein said hood and hood aperture are formed on said front portion.

3. A toy vehicle as set forth in claim 2 wherein said chassis includes a pivot notch and wherein said beam includes a pivot member received within said pivot notch to provide pivotal securing of said pivot beam to said chassis.

4. A toy vehicle as set forth in claim 3 wherein said body includes an internal locking arm extending to said pivot member to captivate said pivot member within said pivot notch.

5. A toy vehicle as set forth in claim 2 wherein said first and second pairs of wheels are the front and rear wheel pairs of said vehicle respectively.

6. A toy vehicle as set forth in claim 5 further including a pair of enlarged annular rear-wheels securable to said second pair of wheels.

7. A toy vehicle having a pair of front wheels and a pair of rear wheels, said toy vehicle comprising:

a vehicle body defining an interior cavity, a hood portion and a hood aperture;

a chassis secured to said vehicle body and supporting said pair of front wheels, said chassis defining a pivot notch and an opening reward thereof and a pair of latch members defining inwardly extending ribs; and a pivot beam having a forwardly extending arm terminating in a simulated engine, a pair of resilient rearwardly extending arms supporting said pair of rear wheels and passing through said opening, a pivot received within said pivot notch, and a pair of outwardly extending pivot buttons supported upon said resilient rearwardly extending arms, said pivot beam pivotable between a first position in which said pivot buttons extend above said latch members and said rear wheels are raised and said engine is lowered with respect to said chassis and a second position in which said pivot buttons extend below said latch members and said rear wheels are lowered and said engine is raised through said hood aperture of said body.

* * * * *